US005261237A

United States Patent [19]

Benson

[11] Patent Number: 5,261,237

[45] Date of Patent: Nov. 16, 1993

[54] OIL DRAIN AND TURBO ASSEMBLY SUPPORT

[76] Inventor: Steven R. Benson, 5919 S. 350 West, Murray, Utah 84107

[21] Appl. No.: 983,044

[22] Filed: Nov. 30, 1992

[51] Int. Cl.[5] ..... F02B 33/44

[52] U.S. Cl. ..... 60/605.1; 417/407

[58] Field of Search ..... 60/605.1; 417/407; 184/6.16

[56] References Cited

U.S. PATENT DOCUMENTS

| | | | |
|---|---|---|---|
| 2,206,414 | 7/1940 | Markey | 285/94 |
| 2,774,618 | 12/1956 | Alderson | 285/223 |
| 3,218,029 | 11/1965 | Woollenweber, Jr. | 60/597 |
| 4,009,972 | 3/1977 | Sarle | 417/407 |
| 4,294,073 | 10/1981 | Neff | 60/597 |
| 4,373,329 | 2/1983 | Martini | 60/305 |
| 4,480,440 | 11/1984 | Harper et al. | 60/605.1 |
| 4,503,680 | 3/1985 | Wood | 60/605 |
| 4,514,986 | 5/1985 | Benson | 60/605 |
| 4,850,797 | 7/1989 | Benson | 415/205 |

FOREIGN PATENT DOCUMENTS

| | | | |
|---|---|---|---|
| 0015721 | 1/1983 | Japan | 417/407 |

*Primary Examiner*—Richard A. Bertsch
*Assistant Examiner*—Charles G. Freay
*Attorney, Agent, or Firm*—Russell, M. Reid; M. Reid Russell

[57] ABSTRACT

The invention is in an oil drain and turbo assembly support that includes a tubular body that is open longitudinally to pass a flow of oil draining from a turbocharger bearing assembly through an engine valley pan and back into the engine oiling system. The tubular body is bent to accommodate an offset of the bearing assembly housing oil drain to the hole through the engine valley pan and provides a top end coupling for rigid mounting across which bearing assembly housing oil drain. The opposite tubular body end is necked into a smooth cylindrical surface for telescoping into the valley pan hole and includes an O-ring seal fitted thereto for travel through the valley pan hole and is pulled upwardly into sealing engagement with the hole edge when the tubular body top end coupling is secured to the bearing assembly housing. A cross bar is arranged across the tubular body and includes fastener mounts at the ends thereof that receive fasteners for rigid coupling into the side of an engine mounted compressed air intake manifold, the tubular body for providing a columnar support between the turbocharger and the engine mounted compressed air intake manifold. Which cross bar provides a collar for covering over a crank case anti-depression valve opening into the compressed air intake manifold.

6 Claims, 4 Drawing Sheets

OIL DRAIN AND TURBO ASSEMBLY SUPPORT

BACKGROUND OF THE INVENTION

1. Field of the Invention

This invention relates to tubes and pipes and their arrangement for both transferring lubrication oil from a lubricating oil drain of an engine exhaust gas turbine and as a support for supporting the turbo system to the engine.

2. Prior Art

Pipes formed as drains to pass lubricating oil from a bearing assembly of an exhaust gas driven turbine air compressor or turbocharger back to an engine oiling system are not new. Such drain tubes or pipes, however, have not heretofore also functioned as structural supports between the turbocharger and engine. Nor have they been easy to install as a drain line between a turbine air compressor oil drain and into the engine valley pan. Unique to the invention, the oil drain tubular body end coupling into the engine valley pan provides a smooth cylindrical end for fitting into a hole in the engine valley pan that allows for some flexure or travel between the engine and turbo components, respectively, and further includes a seal arrangement for prohibiting a passage of oil along the outer surface of which sleeve and onto the engine valley pan.

An exhaust gas transfer manifold as a component of a turbo systems that provides for a smooth exhaust gas flow transition to and from an exhaust gas driven turbine air compressor has been developed by the present inventor and is set out in a U.S. Pat. No. 4,850,797. Which '797 patent is directed to manifold systems, but also shows a telescoping end coupling arrangement between an engine manifold and inlet and outlet sides of an exhaust gas driven turbine air compressor. The manifold of the '797 patent does not, however, serve as a drain or function as a support member. Also, a manifold arrangement is shown in another patent of the present inventor, U.S. Pat. No. 4,514,986 that is also structurally and functionally unlike the invention.

The telescoping end couplings of the above set out patents, are pipe and sleeve coupling. Whereas the tube end of the invention is an inwardly necked end section that is for sliding into a hole or opening formed in the engine valley pan. Which tube end also includes a ring seal for preventing oil from flowing up the tube and onto the valley pan, and is therefore unlike the manifolds and their telescoping end couplings of the aforesaid patents.

Additional to the turbine housing and end couplings of the '797 and '986 patents of the present inventor, a number of other turbine housings with connecting pipes have been developed by others. Examples of such earlier turbine housings and connecting tubes or pipes are shown in patents to Woollenweber, Jr., U.S. Pat. No. 3,218,029; to Neff, U.S. Pat. No. 4,294,073; to Martini, U.S. Pat. No. 4,373,329; and to Wood, U.S. Pat. No. 4,503,680. None of which turbine housing and connecting tubes and pipe arrangements, however, involve a drain line that is also arranged as structural support member. Also, none involve a pipe or tube with a necked end and a seal arrangement for mounting into a hole that is like that of the invention.

The drain and support of the invention, provides for a rigid mounting at one end to a turbo bearing assembly oil drain and is additionally secured as a turbo system component support at spaced points on the side of a compressed air intake manifold, with the other drain end arranged for sliding and sealing into a hole or opening in an engine valley pan. The invention is therefore unlike the telescoping coupling of the earlier '797 patent of the inventor. Further, the invention is similarly distinct from telescoping coupling arrangements shown in patents to Markey, U.S. Pat. No. 2,206,414; and to Alderson, U.S. Pat. No. 2,774,618, and a U.S. patent application, Ser. No. 07/961,669, of the inventor in a uniform flow exhaust gas transfer pipe, that shows a telescoping end coupling. None of which couplings, however, involves a pipe that is arranged as both an oil drain and a support.

The oil drain and turbo assembly support of the invention is also the subject of a design patent application, Ser. No. 07/892,342, filed Jun. 2, 1992.

SUMMARY OF THE INVENTION

It is a principal object of the present invention to provide an oil drain tube and turbo assembly support for rigid mounting between an exhaust gas driven turbine air compressor oil drain and to points on an engine mounted compressed air intake manifold of the turbo system, with the drain and support opposite end fitted into an engine valley pan for draining oil back into the engine oiling system.

Another object of the present invention is to provide an oil drain and turbo assembly support with a connector arrangement for rigid coupling between an exhaust gas driven turbine air compressor oil drain and mounting points on the engine mounted compressed air intake manifold, for providing a columnar support of the turbo system to the engine.

Another object of the present invention is to provide an oil drain and turbo assembly support that also provides for sealing off a crank case anti-depression valve hole in an engine compressed air intake manifold when installed between the exhaust gas driven turbine air compressor oil drain and mounting points on the engine compressed air intake manifold.

Another object of the present invention is to provide for loosely coupling the oil drain and support lower end into an engine valley pan for passing oil drained therethrough, the loose coupling allowing for movement of the drain and support end relative to the engine valley pan hole, wherein it is telescoped.

Still another object of the present invention is to provide an oil drain and support whose lower end is to telescope into the engine valley pan hole and includes a seal arrangement for prohibiting oil from traveling along the outer surface of which lower end and spilling onto the valley pan or engine surface.

Still another object of the present invention is to provide an oil drain and support that is easy and convenient to install utilizing conventional connectors that will require little or no periodic fastener tightening to maintain which oil drain and support in position.

In accordance with the above objects the present invention in an oil drain and turbo assembly support includes a pipe or tubular body with one end arranged for mounting across an oil drain from the bearing assembly of an exhaust gas driven turbine charger, and with the other pipe or tubular body end arranged for sliding or telescoping into a hole or opening that is formed through an engine valley pan for passing oil back to the engine oiling system. Which pipe or tubular body end for sliding into the valley pan holes includes an O-ring type seal for blocking passage of oil along the outside of the tubular body end that would flow onto the valley pan.

Additional to providing an oil drain line, the invention on one end to the turbocharger bearing assembly and at ends of a cross bar secured intermediate therealong to function as a columnar support between the turbocharger and a compressed air intake manifold mounted to the engine. In which configuration, a collar formed at an intermediate location along which cross bar covers and seals over an anti-depression valve opening into the compressed air intake manifold.

THE DRAWINGS

The following drawings illustrate that which is presently regarded as the best mode for carrying out the invention:

DETAILED DESCRIPTION

Figure 1:
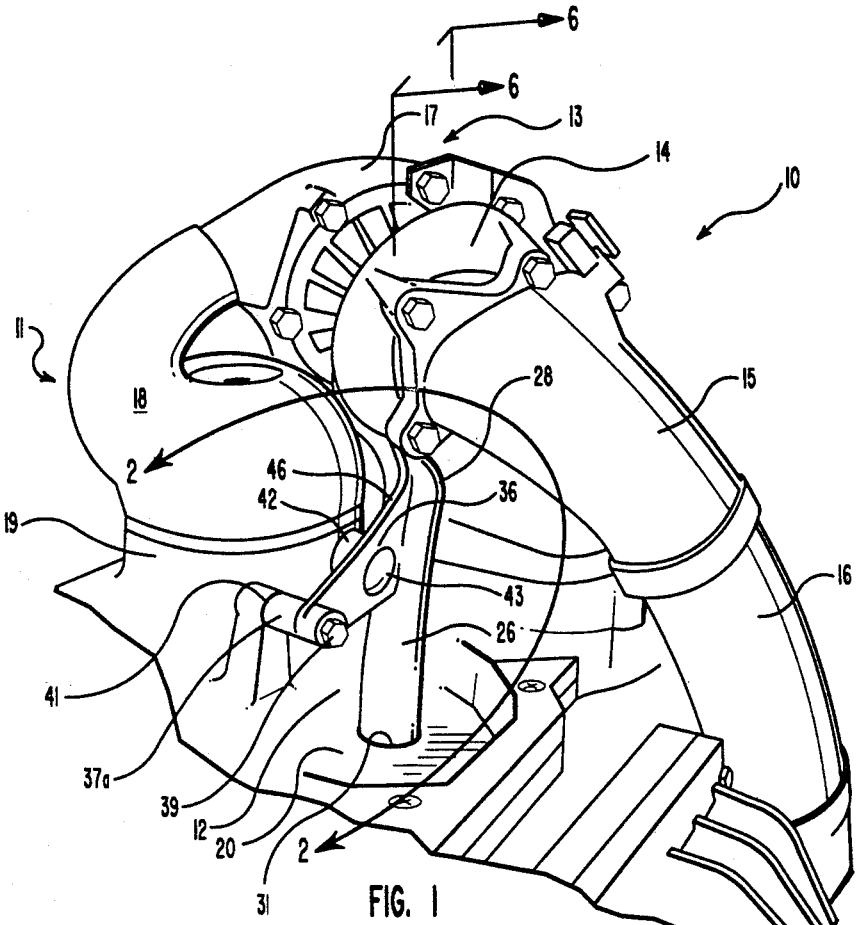
FIG. 1 is a front elevation perspective view of a section of an engine showing an oil drain and turbo assembly support of the invention arranged on one end, between an oil drain of a turbocharger bearing housing with the other end and fitted into a hole or opening in an engine valley pan, and secured at ends of a cross bar thereof to fastening points on a compressed air intake manifold.
Figure 6:
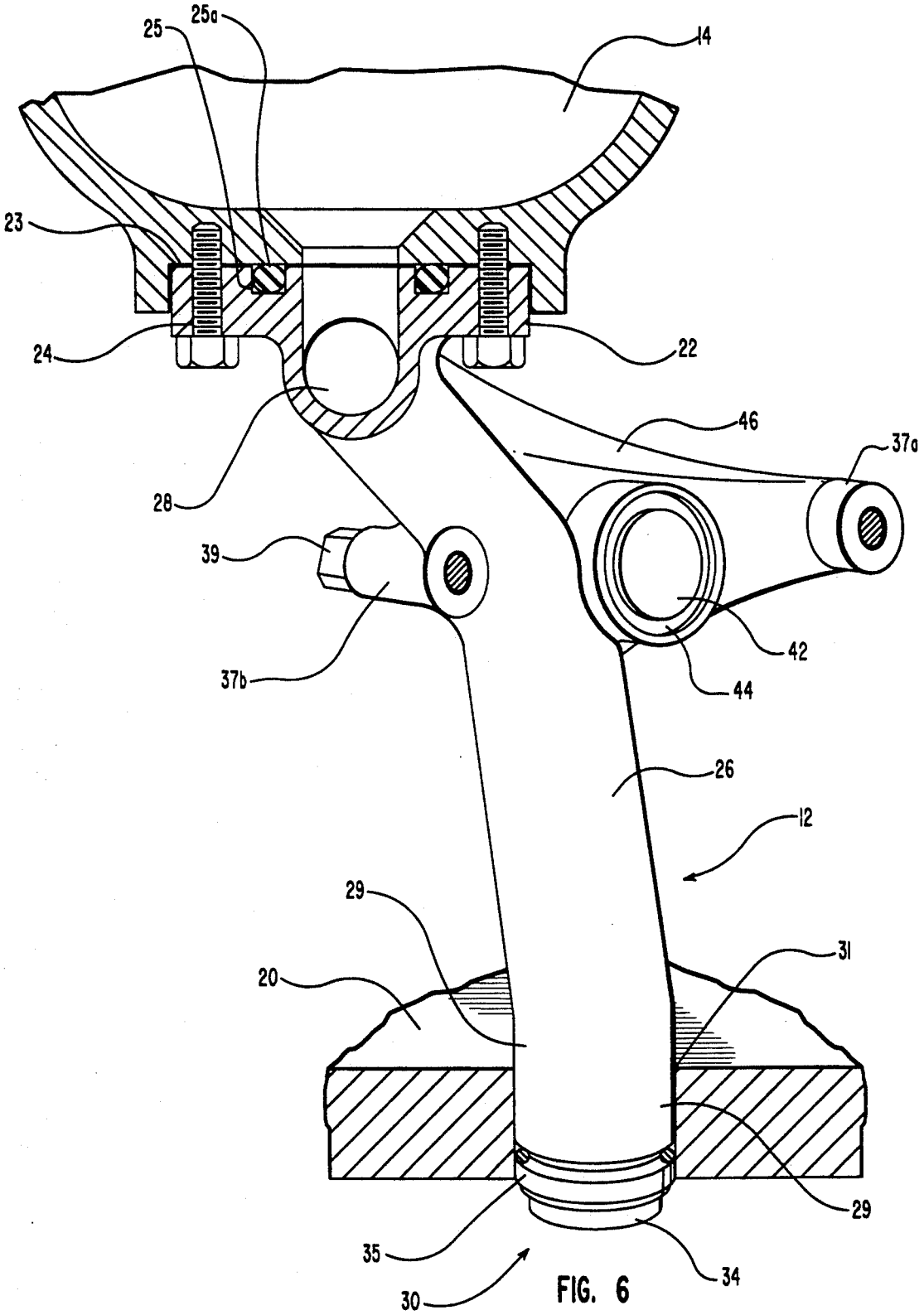
FIG. 6 is a sectional view taken along the line 6—6 of FIG. 1 showing a collar end of the turbo assembly support connected to the turbo charger oil drain, with other turbo assembly support shown, fitted into the bearing assembly housing drain hole.

FIG. 1 and FIG. 6 shows a section of a conventional internal combustion engine 10, hereinafter referred to as engine, whereto are mounted components of a turbo system 11. The turbo system 11 includes an oil drain and turbo assembly support 12 of the invention, hereinafter referred to as drain and support. The turbo system 11, as shown, further includes a turbocharger 13 that has an exhaust inlet housing 14 that is coupled with to receive a vehicle exhaust gas flow delivered from an exhaust inlet chamber 15. The exhaust inlet chamber 15, in turn, receives engine exhaust gas through an engine exhaust line 16. An air compressor side 17 outlet of which turbocharger 13 connects into a pressure chamber 18 that passes compressed air into an engine mounted compressed air intake manifold 19. The turbocharger 13 takes in an inlet air flow, compresses it and passes it to the compressed air intake manifold 19 for mixing with fuel and injection into the engine for ignition.

The turbocharger 13 includes two turbine heads with a bearing assembly therebetween. The one turbine head is turned in the exhaust inlet housing 14 by the vehicle exhaust gases passed therethrough, and turns the other turbine head journaled in the air compressor side 17. The rate of which turbine turning is in thousands of rounds per minute, and accordingly the bearing assembly requires lubrication and cooling. For providing both this required lubrication and cooling, the turbocharger 13 bearing assembly is connected into the engine oiling system to receive engine oil passed into the top thereof that passes therethrough and is drained from a drain hole in the bottom of the bearing assembly housing. In which oil flow passage, the bearing assembly is both lubricated and cooled.

The oil flow, after passage through the bearing assembly is drained through the bearing assembly drain hole to the drain and support 12 of the invention, that passes the waste oil through an engine valley pan 20, an engine valve cover plate that covers the valve system back into the engine oiling system.

Figure 3:
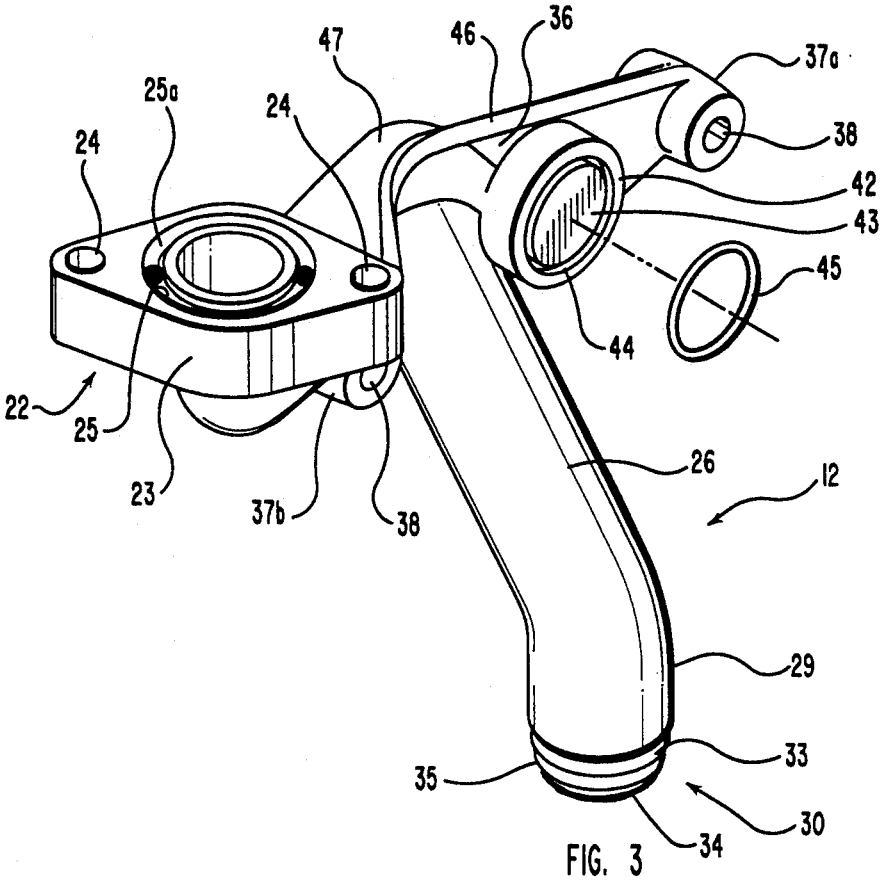
FIG. 3 is an enlarged side elevation perspective view of the oil drain and turbo assembly support of FIG. 2 turned one hundred eighty degrees.
Figure 4:
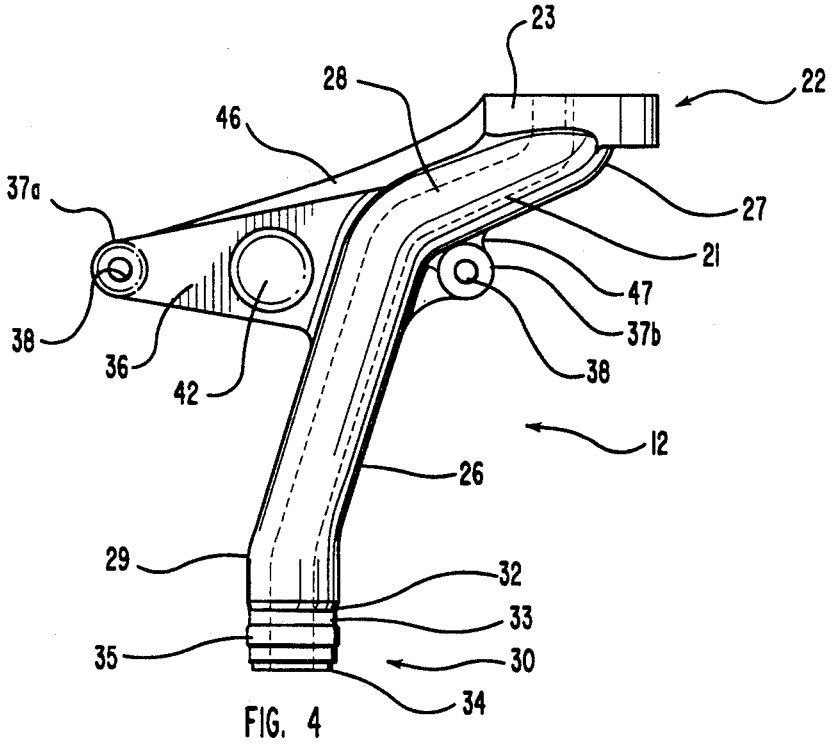
FIG. 4 is a front elevation view of the oil drain and turbo assembly support of FIG. 1 showing in broken lines a longitudinal passage formed therethrough.
Figure 5:
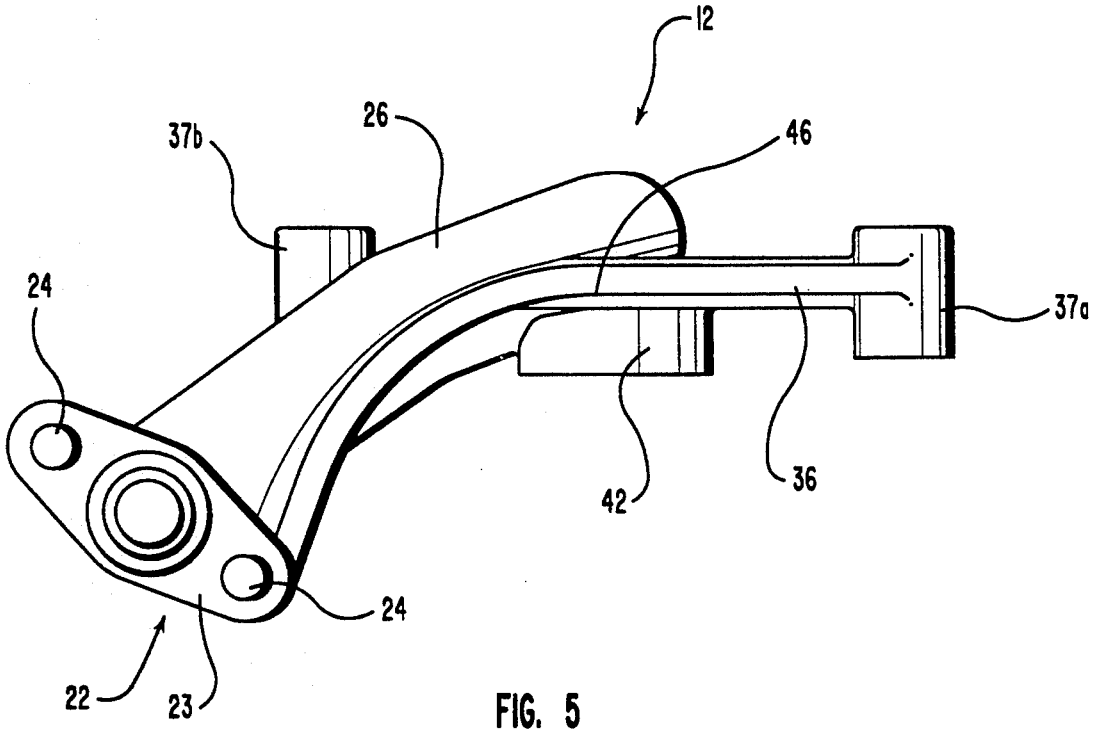
FIG. 5 is a top plan view of the oil drain and turbo assembly support of FIG. 2.

Accordingly, the drain and support 12 includes a longitudinal passage 21 therethrough, as illustrated in broken lines in FIG. 4. Shown in FIGS. 2 through 6, a coupling collar 22, that is shown as a flat diamond shaped section 23, is arranged across the top end of the drain and support 12. The coupling collar 22 is for connection across the drain hole or opening in the bottom of the turbocharger 13 bearing assembly housing, and is mounted thereto by fitting bolts **24*a* with washers 24*b* fitted thereover through a pair of holes 24 that are formed through the plate opposite apex ends and into threaded holes in which bearing assembly housing. Which diamond shaped plate 23 is open at its center into longitudinal passage 21, and is grooved at 25. Grove 25 is for receiving on O-ring seal 25*a* that is fitted therein and is for sealing around the bearing assembly drain hole when the diamond shaped plate 23** is secured thereover.

The drain and support 12, as set out above, is in a tubular body 26 with a cross bar 36 arranged thereacross. Which tubular body, as shown best in FIG. 4, is bent at 27 just below the undersurface of the diamond shaped plate 23 through approximately sixty (60) degrees from the vertical relative to the horizontal diamond shaped plate 23 end face, includes an intermediate dog leg bend 28 back towards the vertical, and is bent back to the vertical at bend 29 that is just above a valley pan 20 telescoping end 30, discussed herein below. The bends 27, 28 and 29 offset the tubular body top end from its valley pan telescoping end 30, compensating for the offset of a hole 31 in valley pan 20 from the bearing assembly drain.

The drain and support 12 tubular body 26 valley pan telescoping end 30 is to be fitted into valley pan hole 31, whereafter the upper or diamond shaped plate 23 is moved under for coupling to the bearing assembly housing undersurface across the drain opening or hole, as set out above. The bends in which drain and support tubular body 26 provide both an offset between the diamond shaped plate 23 end and the valley pan telescoping end 30, and facilitate the tubular body 26 being pivoted across the valley pan hole 31 as the diamond shaped plate 23 is moved into alignment for coupling across the bearing assembly housing drain.

The tubular body 26 valley pan telescoping end 30 is provided to allow for positioning of the upper face of the diamond shaped plate over the bearing assembly housing drain hole, and the aligning of the plate bolt hole 24 with the threaded holes in which bearing assembly housing, not shown, for receiving bolts **24*a* and accordingly must be capable of being slid into which valley pan hole 31, and then pulled a distance therefrom but not out of which valley pan hole as the diamond shaped plate is tightened onto the bearing assembly housing by turning bolts 24***a*. This required travel is provided to the valley pan telescoping end 30 by necking the tubular body 26 inwardly at 32, intermediate the tubular body end and the bend 29, forming a cylindrical surface 33. Additionally, for facilitating fitting the tubular body cylindrical surface 33 into which valley pan hole 31, the cylindrical surface is stepped inwardly at 34, forming the tubular body end.

Additionally, the cylindrical surface 33 is grooved medially for receiving an O-ring type seal 35 that is fitted therearound. Which seal 35 has a circumference to just slide through the valley pan hole 31, as the tubular body cylindrical surface is slid therein. Thereby allowing the diamond shaped plate 22 end of the tubular body 26 to be positioned over the bearing assembly drain hole. Which seal 35, when the coupling collar 22 top surface of diamond shaped plate 23 is bolted to the bearing assembly housing undersurface, is moved upwardly with the tubular body 26 into sealing engagement below and just within the valley pan hole 31. The seal 35 is for providing a barrier against an oil flow passing along the tubular body cylindrical surface 33, up through hole 31 and onto the valley pan 20.

The structure and functioning of the drain and support 12 of the invention as related to its function as a drain line for passing oil from the turbocharger bearing assembly back into the engine oiling system has been described above. Additionally, the invention also serves as a support between the turbocharger 13 and connected turbo system components and the compressed air intake manifold 19 that is mounted to the engine 10. A columnar support is provided by rigidly mounting the tubular body 26 coupling collar 22 onto the turbocharger 23 bearing assembly and connecting the tubular body 26 cross bar 35 to the side of the compressed air intake manifold 19. Cross bar 36 is secured across and at a medial point along the tubular body 26, adjacent to and just below bend 28, the tubular body positioned off center across which cross bar. The cross bar opposite ends 37*a* and 37*b* are formed into cylinders that are at right angles to the crossbar longitudinal axis and are drilled to form holes 38. Which holes 38 are each for receiving, as shown best in FIG. 2, bolts 39 that are fitted therethrough that include washers 40. The bolts 39 are for fitting through holes 38 and turning into a threaded hole that is formed in each of two piers 41, shown in FIG. 1, that extend outwardly from spaced pints on the compressed air intake manifold 19 side. With the drain and support 12 installed, as shown in FIGS. 1 and 6, three points of rigid attachment are provided between the turbocharger 13 and the engine 10 mounted compressed air intake manifold 19.

Figure 2:
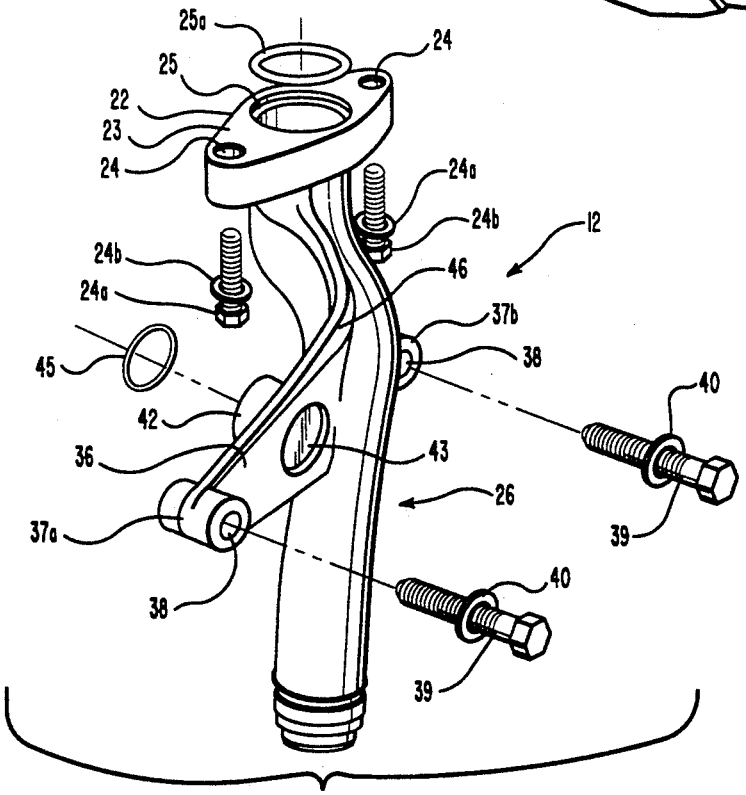
FIG. 2 is an enlarged side elevation perspective view taken within the line 2—2 of FIG. I, showing the drain line and its couplings to the turbo system components removed from the turbo system and exploded apart.

Shown best in FIGS. 2 and 3, a collar 42 is formed in the cross bar 36, at an intermediate point between the cross bar end 37*a* and the tubular body 26. With the cross bar mounted by bolts 39 to the side of the compressed air intake manifold 19, the collar 42 will be immediately opposite to and of greater diameter than a round hole, not shown, that is formed into the compressed air intake manifold of a number of engine configurations. Which round hold is for receiving a crank case anti-depression valve fitted therein. The collar 42, as shown, is closed thereacross forming front and rear faces 43. The front face 43 is opposite to the crank case anti-depression valve hole through which compressed air intake manifold 19 when the drain and support 12 is installed, as described. Shown best in FIG. 3, a circular groove 44 is formed in the collar front face 43 for receiving an O-ring 45 that is fitted therein. The O-ring 45 is of greater diameter than the crank case anti-depression valve hole of the compressed air intake manifold 19 and is for providing a sealing engagement to the surface of which compressed air intake manifold. Where a compressed air intake manifold 19 does not include a crank case anti-depression valve hole formed therein, the collar 42 and O-ring 45 can be dispensed with. Further, the collar 42 and face 43 can be drilled and tapped for accommodating a sensor for checking intake manifold pressure, not shown, within the scope of this disclosure.

The drain and support 12 of the invention, as set out above, provides a rigid support between the turbocharger 13 and the engine mounted compressed air intake manifold 19. Additional to the columnar support provided by the drain and support tubular body 26, in engine and turbocharger operation, it is anticipated that both vertical and lateral forces will be applied to the drain and support that tends to displace the turbo system away from or toward the engine. Such forces would, of course, create bending moments in the tubular body 26, particularly at its junction with cross bar 36. Which junctions are therefore preferably reinforced by the addition to the tubular body 26 and cross bar 36 of flanges or fins 46 and 47, respectively. Which flanges or fins 46 and 47 are effectively hypotenuse sides of right triangles as formed by the junctions of which tubular body 26 and cross bar 36. The fins or webs 46 and 47 individually extend from both the top and bottom surfaces of the cross bar 36 to intersect opposite sides of which tubular body 26, proving a structural reinforcement.

While a preferred embodiment of my invention in an oil drain and turbo assembly support as been shown and described herein, it should be understood that the present disclosure is made by way of example only and that variations and changes thereto are possible without departing from the subject matter coming within the scope of the following claims, and a reasonable equivalency thereof, which claims I regard as my invention.

I claim:

1. An oil drain and turbo assembly support comprising, a tubular body that is open longitudinally and is bent through a plurality of bends from a straight tube to where the tubular body longitudinal axis at said tubular body ends are parallel, and is for mounting between a turbocharger bearing assembly housing drain hole and an opening in an engine valley pan; connector plate means arranged across a top end of said tubular body that includes means for mounting said plate means to the turbocharger bearing assembly bearing across said drain hole; a bottom end portion of said tubular body is necked inwardly into a cylindrical wall for sliding into the engine valley pan opening; seal means for arrangement with said tubular body bottom end portion for prohibiting passage of oil along said bottom end portion and onto said engine valley pan; and a cross bar secured across said tubular body that includes a pair of fastener mounts that are spaced from one another along said cross bar, each said fastener mount for receiving a bolt type fastener means fitted therethrough that is turned into a mounting point on an engine mounted compressed air intake manifold, for providing a rigid coupling thereto.

2. An oil drain and turbo assembly support as recited in claim 1, wherein the connector plate means is a flat diamond shaped section that is open centrally into the tubular body longitudinal passage and has a hole formed through opposite ends of said diamond shaped section; and the bolt type fastener means are bolts, with each said both fitted through each said flat diamond shaped section end hole and turned into one of a pair of threaded holes that are formed in the bearing assembly housing, on opposite sides of the drain hold.

3. An oil drain and turbo assembly support as recited in claim 1, wherein the tubular body portion end portion cylindrical surface is grooved at a median point therealong to receive an O-ring fitted therein as the seal means.

4. An oil drain and turbo assembly support as recited in claim 1, wherein the cross bar fastener mounts are a pair of cylinders that are each formed across an end of said cross bar and are drilled for receiving the bolt type fastener means fitted therethrough and turned into threaded holes that have been formed into the mounting points on the engine mounted compressed air intake manifold.

5. An oil drain and turbo assembly support as recited in claim 4, further including the addition of fins or flanges across the junctions of the tubular body and cross bar for providing structural reinforcement thereto.

6. An oil drain and turbo assembly support as recited in claim 1, further including a closure means positioned at a point along and extending from the cross bar surface to cover a crank case anti-depression valve port in the compressed air intake manifold surface when the tubular body is secured in columnar supporting arrangement between the bearing assembly and said compressed air intake manifold; and an O-ring type seal for positioning between said closure means and said compressed air intake manifold surface around said port for contacting and providing a sealed engagement therebetween.

* * * * *